US006718246B2

(12) United States Patent
Griffith et al.

(10) Patent No.: US 6,718,246 B2
(45) Date of Patent: Apr. 6, 2004

(54) AUTOMATIC IMPLEMENT CONTROL FOR SPREADING MATERIAL WITH A WORK MACHINE

(75) Inventors: Thomas E. Griffith, Aurora, IL (US); Richard G. Ingram, Saint Charles, IL (US); Satish Kale, Lemont, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/131,392

(22) Filed: Apr. 24, 2002

(65) Prior Publication Data

US 2003/0204297 A1 Oct. 30, 2003

(51) Int. Cl.[7] ..... G06F 7/00; G06F 19/00; G06G 7/66

(52) U.S. Cl. ..... 701/50; 701/207; 342/357.17

(58) Field of Search ..... 701/213, 208, 701/205, 215, 28, 50, 207; 342/357.17, 357.09, 357.06; 700/241; 111/130, 903; 37/348, 414; 56/10.2 A, 10.2 H, 10.2 R

(56) References Cited

U.S. PATENT DOCUMENTS 4,630,685 A 12/1986 Huck, Jr. et al.
5,462,125 A * 10/1995 Stratton et al. ..... 172/826
5,897,600 A * 4/1999 Elmore et al. ..... 701/50
5,911,769 A * 6/1999 Orbach et al. ..... 701/50
5,918,682 A 7/1999 Fan et al.
6,091,997 A * 7/2000 Flamme et al. ..... 700/83
6,199,000 B1 * 3/2001 Keller et al. ..... 701/50
6,230,091 B1 * 5/2001 McQuinn ..... 701/50
6,282,453 B1 8/2001 Lombardi
6,363,632 B1 * 4/2002 Stentz et al. ..... 37/414
2001/0018638 A1 * 8/2001 Quincke ..... 701/213

* cited by examiner

*Primary Examiner*—Thomas G. Black
*Assistant Examiner*—Ronnie Mancho
(74) *Attorney, Agent, or Firm*—James R Smith

(57) ABSTRACT

A work machine is often used to spread material from an initial location across a wider area. It is desirable to raise and lower a work implement of the work machine such that the material can be quickly and easily spread to a uniform or otherwise desirable thickness. The present invention provides a method and apparatus of automatically controlling the position of the work implement. The automatic implement control system of the present invention lowers and raises the work implement based on at least one of a directional characteristic of the work machine and a position of an operator input device. The work implement is then automatically lowered or raised to the desired position to facilitate an efficient work cycle for spreading material.

8 Claims, 3 Drawing Sheets

JOY STICK
R - RAISE
L - LOWER
N - NEUTRAL
F - FLOAT

TRANSMISSION
FD - FORWARD
RE - REVERSE

IMPLEMENT
SL - SET POINT LOWER
SR - SET POINT RAISE

CYLINDER
P - CYLINDER POSITION

JOY STICK
LD - LOWER DETENT
RD - RAISE DETENT

IMPLEMENT
SL - SET POINT LOWER
SR - SET POINT RAISE

CYLINDER
P - CYLINDER POSITION

AUTOMATIC IMPLEMENT CONTROL FOR SPREADING MATERIAL WITH A WORK MACHINE

TECHNICAL FIELD

This invention is related to a control system for an implement of a work machine and, more specifically, to a control system that raises and lowers the implement automatically to facilitate the spreading or dissemination of loose material by the work machine.

BACKGROUND

It is common for a work machine such as a wheel loader to be fitted with a blade and used for material spreading tasks. In such an application, the operator of the work machine moves the blade to a higher or a lower position to aid in spreading out the material. More specifically, the operator will usually have the blade in a lower position when the work machine moves forward, in order to spread out the material from a pile. The operator will then raise the blade while or before moving the machine in reverse, so that the spread material is not dragged back toward its original position by the back side of the blade. The operator then drops the blade back down to the lower position to catch more material from the pile and the machine moves forward to push the additional material away from its original position. This type of spreading is commonly done in landfill or soil compaction applications.

It is obvious that the work cycle described above requires multiple motions from the operator (lowering and raising the blade and controlling the work machine in forward and reverse directions) which are accomplished through the manipulation of various levers, joysticks, or the like in the operator compartment. This myriad of motions for each work cycle can be fatiguing for the operator and lead to an inefficient work cycle as the operator tires.

U.S. Pat. No. 5,462,125, issued Oct. 31, 1995 to Ken L. Stratton et al. (hereafter referenced as '125) discloses a device and method for automatically moving the vehicle implement to one of several pre-set blade angle positions (col. 1, lines 7–9). The operator selects the automatic tilt mode by depressing the automatic tilt mode switch which sends an automatic tilt signal to the electronic control. The electronic control will thereafter issue a command to move the tilt cylinders to the pre-set blade angle corresponding to the given position of the thumb switch (col. 4, lines 20–26).

The '125 apparatus includes no provisions for allowing the operator to set raise and lower limit values, but merely allows the operator to choose from a group of preset tilt angle values. Therefore, the operator loses a portion of control over the precise placement of the implement. '125 also does not to allow the work machine to automatically engage the implement control system. Finally, '125 does not relate the implement control to a travel direction of the work machine, which would be advantageous in repeat-pass spreading.

Accordingly, the art has sought a method and apparatus of an implement control system that: reduces operator effort and fatigue, includes preselected and/or operator-chosen raise and lower limit values, relates implement control to a travel direction of the machine, and is economical to manufacture and use. The present invention is directed to solving one or more of the above problems.

SUMMARY OF THE INVENTION

In an embodiment of the present invention, a method for spreading material with a work machine is disclosed. The work machine has an operator input device, an implement, a ground-engaging device, and an implement position sensing system. The method includes the steps of: sensing a condition of the operator input device, responsively producing an operator input signal, sensing an implement position, and responsively producing an implement position signal. The method also includes the steps of: providing a programmable device for receiving the operator input signal and the implement position signal and responsively producing and outputting an implement position command, receiving the implement position command, and responsively controlling a position of the implement.

In an embodiment of the present invention, an automatic implement control system for a work machine is disclosed. The automatic implement control system includes: a work implement attached to the work machine, an implement sensor adapted to sense a work implement position and responsively produce an implement position signal, an operator input device assembly adapted to sense an operator command and responsively produce an operator input signal, and an electronic control module adapted to receive the implement position signal and operator command signal and responsively produce a work implement command signal to control the work implement to a predetermined position.

In an embodiment of the present invention, a method of controlling the position of a work implement is disclosed. The method includes the steps of: determining a raise limit, determining a lower limit, sensing an operator command and responsively producing an operator input signal, sensing a work implement position and responsively producing an implement position signal, and sensing a machine direction and responsively producing a machine direction signal. The method also includes the steps of: providing a programmable device for receiving the operator command signal, the implement position signal, and the machine direction signal; responsively producing an implement command signal; moving the work implement toward the raise limit when the transmission signal has a value of reverse; and moving the work implement toward the lower limit when the transmission signal has a value of forward.

In an embodiment of the present invention, a method of controlling the position of a work implement is disclosed. The method includes the steps of: predetermining a raise limit, predetermining a lower limit, sensing a position of an operator input device and responsively producing an operator input signal, and sensing a work implement position and responsively producing an implement position signal. The method also includes the steps of: providing a programmable device for receiving the operator input signal and the implement position signal, responsively producing an implement command signal, moving the work implement toward the raise limit when the operator input signal has a first predetermined value, and moving the work implement toward the lower limit when the operator input signal has a second predetermined value.

In an embodiment of the present invention, a method for spreading material with a work machine is disclosed. The work machine has an operator input device, an implement, a ground-engaging device, and an implement position sensing system. The method includes the steps of: sensing a condition of the operator input device, responsively producing an operator input signal, sensing an implement position, responsively producing an implement position signal, sensing at least one of a machine travel direction condition and a detent position of the operator input device, and responsively producing at least one of a machine direction signal and a detent signal. The method also includes the steps of: receiving at least two of the operator input signal, the implement position signal, the machine direction signal, and the detent signal, and responsively producing an implement position command; receiving the implement position command; and responsively controlling a position of the implement.

DETAILED DESCRIPTION

A preferred embodiment of the present invention provides an apparatus and method of an automatic implement control system. The following description uses a wheel loader as an example only. This invention may be applied to other types of work machines, such as a wheel dozer, track type tractor, or any other suitable work machine.

Figure 1:
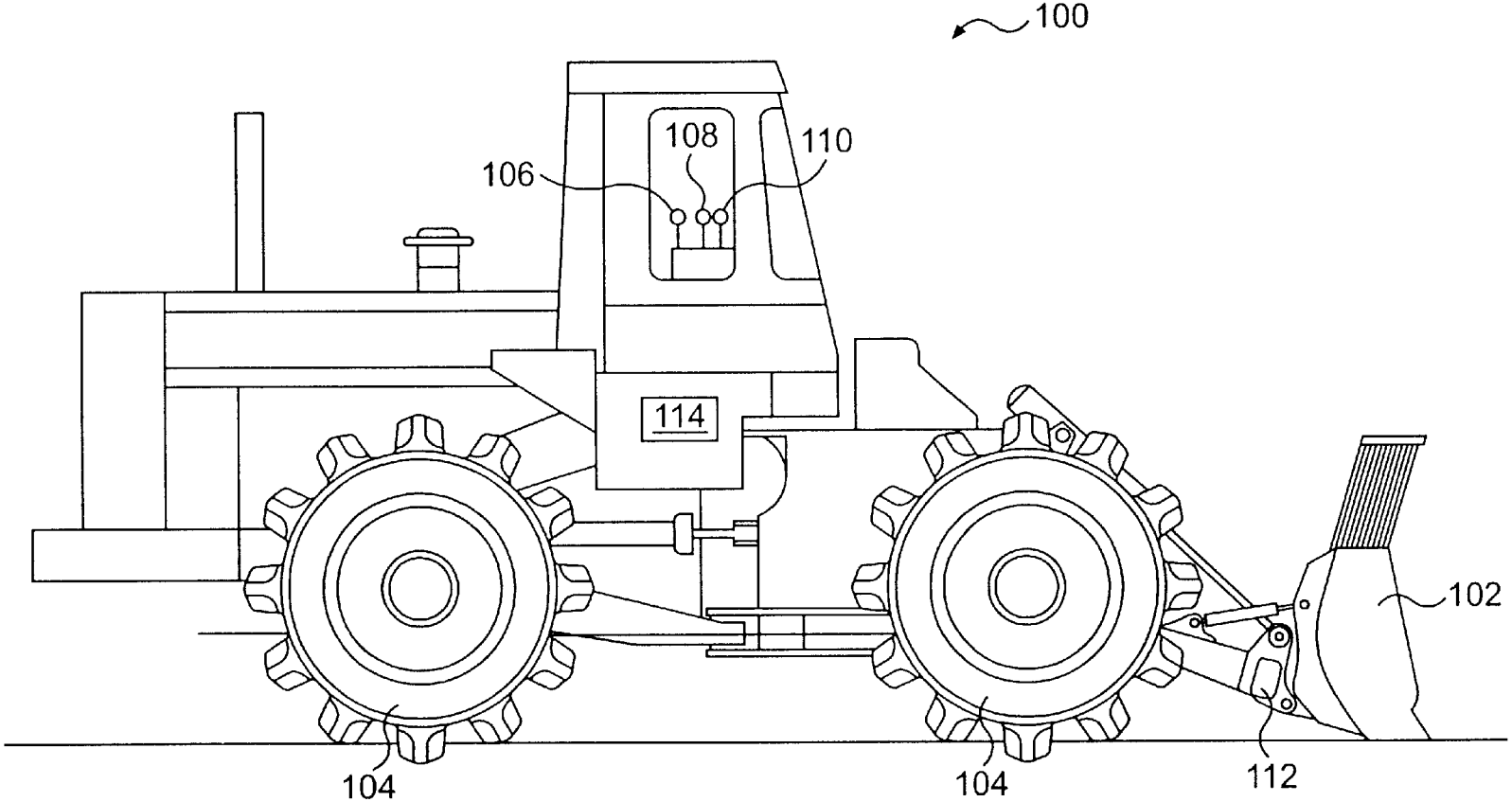
FIG. 1 is a side view of a wheel loader according to the present invention.

FIG. 1 depicts a work machine 100 according to the present invention. The work machine 100 has a work implement 102, shown here as a blade 102, and a ground-engaging device 104, shown here as wheels 104. The work machine 100 also has at least one operator input device 106,108,110 and an implement position sensing system 112.

In a preferred embodiment, there are three operator input devices 106,108, 110 comprised of a directional control 106, an implement control 108, and a limit set control 110. The operator input device 106,108,110 is adapted to convert an operator's command to a signal in a known manner and may be one or a combination of joysticks, levers, buttons, selectors, knobs, touch screens, and the like. The directional control 106 is optionally adapted to control the direction of work machine travel in one of a forward, reverse, or neutral position, as is known in the art. The implement control 108 is optionally adapted to control a movement of the work implement 102 in a raise, lower, neutral, or float position, as is known in the art. The limit set control 110 is optionally adapted to accept an operator's indication of a limited range for available work implement 102 travel. The operator input device 106,108,110 may include detent positions to maintain the operator's command, again in a known manner. The operator input device 106,108,110 may also include an apparatus to activate or deactivate the automatic implement control system of the present invention.

The operator input signal indicates a position of the operator input device 106,108,110 and, as such, may be separate signals for each joystick, lever, button, or the like included in the operator input device 106,108,110, or may be a single signal having various components to indicate the positions of each element of the operator input device 106,108,110 system. Here, the operator input signal may include, and is not limited to, a machine direction signal, an operator implement command signal, a detent signal, a machine travel direction condition, raise, lower, neutral, float, and the like. It is common in the art for a group of operator-manipulable components to send signals to a central controller, and any suitable method of conveying the operator's intentions and commands to the work machine would fall under the operator input signal of the present invention, as described and used below.

The implement position sensing system 112 may operate in any suitable manner and is adapted to produce an implement position signal to indicate the position of the work implement 102. The operator input device 106,108,110 is preferably adapted to produce an operator input signal containing elements of at least one of a machine direction signal, an implement command signal, and a detent signal.

A signal receiving device which may comprise a programmable device such as an electronic control module ("ECM") 114, a pilot hydraulic system, or the like is adapted to receive signals from the operator input device 106,108, 110 and from the implement position sensing system 112 and to responsively produce an implement command signal. The implement command signal is then transmitted to the work implement 102 in a known manner to control a position of the work implement 102 to a desired position.

In a preferred embodiment, the ECM 114 is a microcontroller of a known type. However, other suitable ECMs 114 are known in the art, any of which could be readily and easily used in connection with an embodiment of the present invention. A specific program code can be readily and easily written from the flowcharts, shown in FIGS. 2 and 3, in the specific assembly language or microcode for the selected ECM 114. The ECM 114 is adapted to receive signals from the operator input device 106,108,110 and from the implement position sensing system 112 and to responsively produce an implement command signal. Preferably the ECM 114 is one of many readily available computers capable of processing numerous instructions. It should be appreciated that the computer may include multiple processing units configured in a distributed structure environment and forming a system. The computer also may include random-access memory (RAM) and/or read-only memory (ROM) as needed to facilitate proper operation of the present invention.

Figure 2:
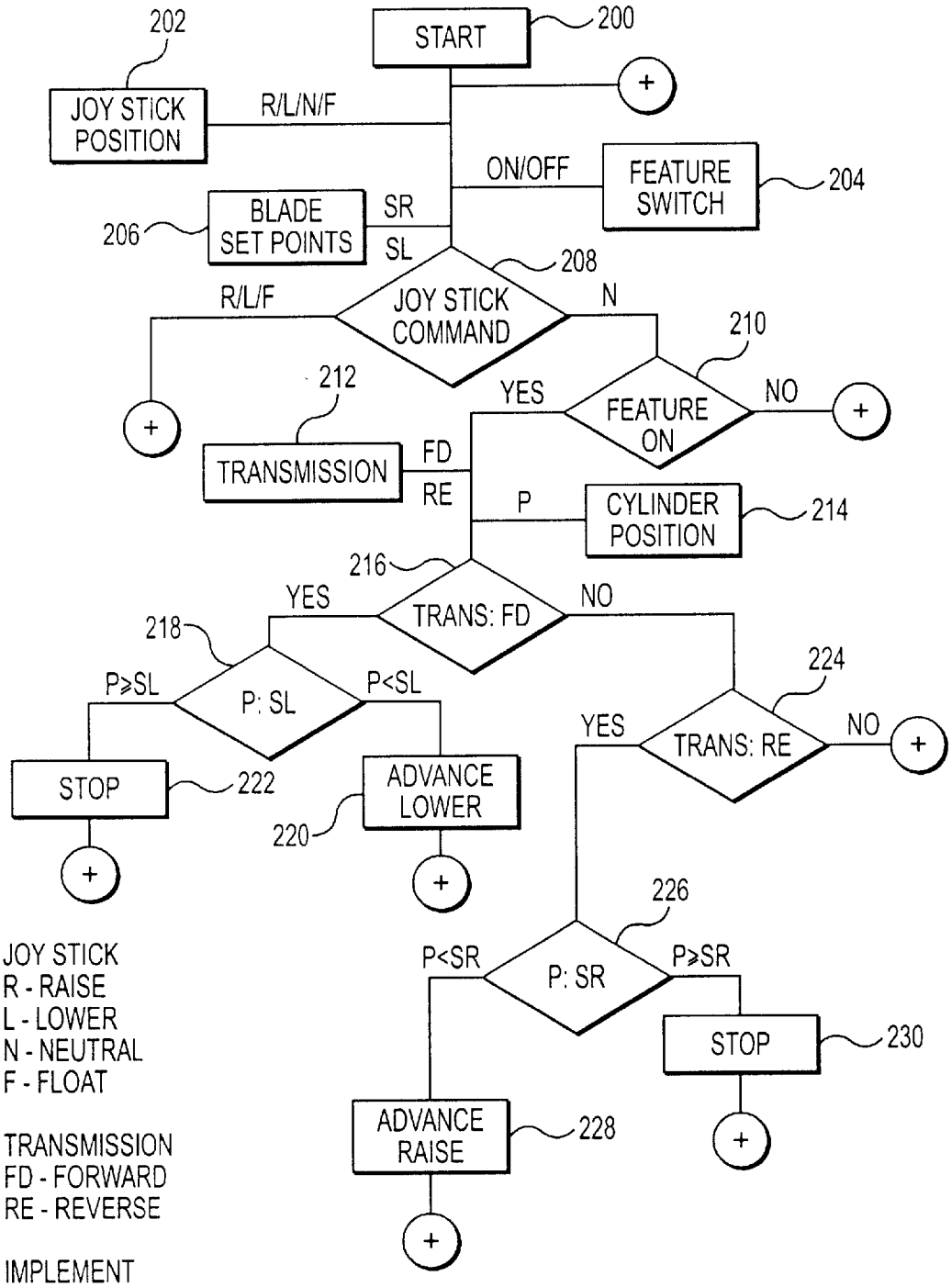
FIG. 2 is a flow chart of a preferred embodiment of the present invention.

FIG. 2 depicts a flowchart of a preferred embodiment of the present invention. The logic begins with a start block 200. Any errors of inputs or decisions will cause the logic to automatically return to the start block 200 and preferably will alert the operator of the error in a known manner. A first input block 202 provides an implement control signal having a value of raise, lower, neutral or float. A second input block 204 provides a limit signal which comprises the desired raise and/or lower limit values for the work implement 102. A third input block 206 provides a automatic control signal which indicates the activation/deactivation state of the automatic implement control system. At the first decision block 208, the implement control signal is examined. If the implement control signal value is raise, lower, or float, the automatic implement control system is overridden and the logic of the program returns to the start block 200.

Figure 3:
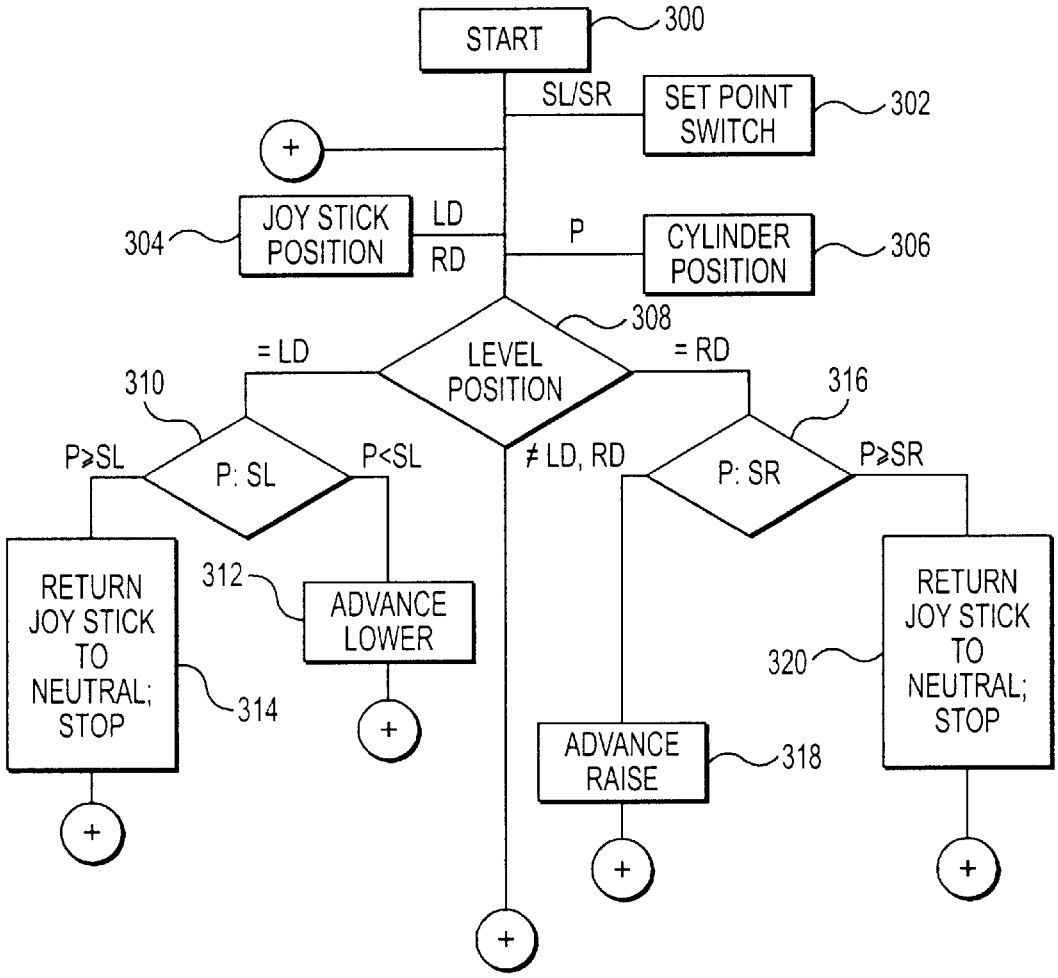
FIG. 3 is a flow chart of a preferred embodiment of the present invention.

Optionally, at the first decision block 208, an implement control signal value of raise or lower could cause the logic to progress to a start block 300 of the preferred embodiment depicted in FIG. 3. The preferred embodiment shown in FIG. 3 will be discussed in detail below.

If the implement control signal value is neutral, the logic continues to a second decision block 210. At the second decision block 210, the automatic control signal is examined to determine if the automatic implement control system is activated. If the automatic implement control system is not activated, the logic returns to the start block 200.

If the automatic implement control system is activated, the logic progresses to fourth and fifth input blocks 212, 214. The fourth input block 212 provides a machine direction signal, which can have a value of forward or reverse. The fifth input block 214 provides an implement position signal, which is indicative of a position of the work implement. The logic then progresses to a third decision block 216. At the third decision block 216, the machine direction signal is examined.

If the value of the machine direction signal at the third decision block 216 is forward, then the logic progresses to a fourth decision block 218. At the fourth decision block 218, the implement position signal is compared to the lower limit value. If the value of the implement position signal is greater than the lower limit value, a lower command is sent to the work implement 102 at a first command block 220 and the logic returns to the start block 200. If the value of the implement position signal is equal to or less than the lower limit value, a stop command is sent to the work implement 102 at a second command block 222 and the logic returns to the start block 200.

If the value of the machine direction signal at the third decision block 216 is not forward, the logic progresses to a fifth decision block 224. At the third decision block 216, the machine direction signal is again examined. If the value of the machine direction signal at the fifth decision block 224 is not reverse, then the logic returns to the start block 200. If the value of the machine direction signal at the fifth decision block 224 is reverse, then the logic progresses to a sixth decision block 226.

At the sixth decision block 226, the value of the implement position signal is compared to the raise limit value. If the implement position signal is less than the raise limit value, a raise command is sent to the work implement 102 at a third command block 228 and the logic returns to the start block 200. If the value of the implement position signal is equal to or greater than the raise limit value, a stop command is sent to the work implement 102 at a fourth command block 230 and the logic returns to the start block 200.

FIG. 3 depicts a flowchart of another preferred embodiment of the present invention. The logic begins with the start block 300. Any errors of inputs or decisions will cause the logic to automatically return to the start block 300 and preferably will alert the operator in a known manner of the error. A first input block 302 provides a limit signal which comprises the desired raise and/or lower limit values of the work implement 102. A second input block 304 provides an operator input signal having a value of raise detent, lower detent, or other (that is, having a value other than raise or lower detent). A third input block 306 provides an implement position signal indicative of the position of the work implement. The logic then progresses to a first decision block 308.

At the first decision block 308, the operator input signal is examined. If the operator input signal is other, the logic returns to the start block 300. If the operator input signal is lower detent, the logic progresses to a second decision block 310.

At the second decision block 310, the implement position signal is compared to the lower limit value. If the implement position signal is greater than the lower limit value, a lower command is sent to the work implement 102 at a first command block 312 and the logic returns to the start block 300. If the implement position signal is less than or equal to the lower limit value, a stop command is sent to the work implement 102 and a release-from-detent signal is sent to the operator input device 108 at a second command block 314, and the logic returns to the start block 300.

If the value of the operator input signal at the first decision block 308 is raise detent, the logic progresses to a third decision block 316. At the third decision block 316, the implement position signal is compared to the raise limit value. If the value of the implement position signal is less than the raise limit value, a raise command is sent to the work implement 102 at a third command block 318 and the logic returns to the start block 300. If the value of the implement position signal is equal to or greater than the raise limit value, a stop command is sent to the work implement 102 and a release-from-detent signal is sent to the operator input device 108 at the fourth command block 320 and the logic returns to the start block 300.

While aspects of the present invention have been particularly shown and described with reference to the preferred embodiments above, it will be understood by those skilled in the art that various additional embodiments may be contemplated without departing from the spirit and scope of the present invention. For example, the raise and lower limit signals could be reversed to cause the opposite motion of the work implement 102 as described above, the automatic implement control system could be activated automatically, or the inputs and decisions could occur in any other practicable order. However, a device or method incorporating such an embodiment should be understood to fall within the scope of the present invention as determined based upon the claims below and any equivalents thereof.

Industrial Applicability

A work machine 100 is engaged in spreading material away from an original position using a work implement 102, such as a blade 102, to push the material. An operator of the work machine 100 desires to use the automatic implement control system of the present invention. The operator may activate the automatic implement control system by using the operator input device 106,108,110 to set limits for the raising and lowering of the work implement 102, by activating a switch or button, by triggering a section of the control programming of the work machine 100, by placing an implement control 108 in a detent position, and/or by any other suitable method.

Once the automatic implement control system is activated, the logic embodied in FIGS. 2 and 3 goes into effect. As FIGS. 2 and 3 describe different embodiments of the same invention, they will be described below separately. It is intuitively obvious to those skilled in the art that the embodiments described below perform the same function and may both be available to the operator at the same time. The separate descriptions of the embodiments should not be used to limit the scope and spirit of the present invention.

For the preferred embodiment shown in FIG. 2, the operator activates the automatic implement control system in any suitable manner. The operator may optionally set raise and lower limit values for the work implement 102, possibly by moving the work implement 102 to the raise or lower limit position and activating a limit set control 110, or those values may be otherwise predetermined. When the operator uses the operator input device 106 to indicate a forward direction of travel for the work machine 100, the work implement 102 automatically lowers until it is at a desired lower position. When the operator uses the operator input device 106 to indicate a reverse direction of travel for the work machine 100, the work implement 102 automatically raises until it is at a desired raise position. These work implement 102 position changes may begin as soon as the operator input device 106,108,110 is changed to indicate the desired travel direction, and the operator can then decide to move the work machine 100 immediately or to wait for the work implement 102 to reach the desired position; or optionally, the work implement 102 position changes may begin approximately concurrently with a movement of the ground-engaging device 104 in order to soften or modulate a change in the level or thickness of the material being spread.

For the preferred embodiment shown in FIG. 3, the operator activates the automatic implement control system in any suitable manner. The operator may optionally set raise and lower limit values for the work implement 102, possibly by moving the work implement 102 to the raise or lower limit position and activating a limit set control 110, or those values may be otherwise predetermined or even programmed into the ECM 114. In order to trigger or begin movement of the work implement 102 toward the desired raise or lower limit position, the operator places the implement control 108 into the respective raise or lower detent position in a known manner. The implement control 108 is then held in that detent position until the work implement 102 reaches the desired position, at which point the implement control 108 is automatically released from the detent position (perhaps to a neutral position to avoid any other movement of the work implement 102) again in a known manner. Once the implement control 108 is released from the detent position, the operator may further control the position of the work implement 102 manually as desired. The operator may activate the ground-engaging device 104 to move the work machine 100 as desired, either while or after the work implement 102 is moving to the ordered and desired position.

It should be understood that while a preferred embodiment is described in connection with a wheel loader, the present invention is readily adaptable to provide similar functions for other work machines. Other aspects, objects, and advantages of the present invention can be obtained from a study of the drawings, the disclosure, and the appended claims.

What is claimed is:

1. A method of controlling an implement of a work machine having an operator input device and a ground-engaging device, comprising the steps of:

sensing a condition of the operator input device;

responsively producing an operator input signal;

sensing an implement position;

responsively producing an implement position signal;

sensing a machine travel direction condition comprising one of a forward direction or a reverse direction;

responsively producing a machine direction signal; and providing a signal receiving device for receiving the machine direction signal, the operator input signal, and the implement position signal, and responsively producing an implement position command and in response thereto automatically moving the implement in a one direction when said machine travel direction condition is forward, and in another direction when said machine travel direction condition is reverse.

2. The method of claim 1, further comprising:

predetermining a raise limit position;

predetermining a lower limit position; and controlling the position of the implement to at least one of the raise limit position and the lower limit position.

3. The method of claim 1, further comprising:

predetermining a raise limit position;

predetermining a lower limit position;

controlling the position of the implement to one of the raise limit position and the lower limit position when the machine direction signal has a first value; and controlling the position of the implement to the other of the raise limit position and the lower limit position when the machine direction signal has a second value.

4. An automatic implement control system for a work machine, comprising:

a work implement attached to the work machine;

an implement sensor adapted to sense a work implement position and responsively produce an implement position signal;

an operator input device assembly adapted to sense an operator command and responsively produce an operator input signal;

an electronic control module adapted to receive the implement position signal, machine direction signal and operator input signal and responsively produce a work implement command signal to control the work implement to a predetermined position;

said operator input device assembly has at least a raise detent position, a lower detent position, and a neutral position, and wherein the work implement command signal controls the work implement to at least one of a predetermined raise limit position and a predetermined lower limit position based on the operator input device assembly being in the raise detent position and the lower detent position respectively; and said electronic control module releases the operator input device assembly to the neutral position when the work implement has reached at least one of the predetermined raise limit position and the predetermined lower limit position.

5. The automatic implement control system of claim 4, further comprising a ground-engaging device attached to the work machine and adapted to provide motive power to the work machine, wherein the ground-engaging device has a directional characteristic associated with a directional signal, and wherein the electronic control module is adapted to receive the directional signal and responsively produce the work implement command signal.

6. The automatic implement control system of claim 4, wherein the directional characteristic is at least one of forward, reverse, and neutral, and wherein the work implement is controlled to one of the predetermined raise limit position and the predetermined lower limit position when the directional characteristic is forward and the work implement is controlled to the other of the predetermined raise limit position and the predetermined lower limit position when the directional characteristic is reverse.

7. A method of controlling the position of a work implement, comprising:

determining a raise limit;

determining a lower limit;

sensing an operator command and responsively producing an operator input signal;

sensing a work implement position and responsively producing an implement position signal;

sensing a machine direction and responsively producing a machine direction signal;

providing a signal receiving device for receiving the operator input signal, the implement position signal, and the machine direction signal and responsively producing an implement command signal;

automatically moving the work implement toward the raise limit when the machine direction signal has a value of reverse; and automatically moving the work implement toward the lower limit when the machine direction signal has a value of forward.

8. An automatic implement control system for a work machine, comprising:

a work implement attached to the work machine;

an implement sensor adapted to sense a work implement position and responsively produce an implement position signal;

an operator input device assembly adapted to sense an operator command and responsively produce an operator input signal;

an electronic control module adapted to receive the implement position signal and operator input signal and responsively produce a work implement command signal to control the work implement to a predetermined position; and wherein the operator input signal has a value of one of raise, lower, neutral, or float and wherein the automatic implement control system is disengaged if the value is raise, lower, or float and wherein the automatic implement control system is engaged if the value is neutral.

* * * * *